United States Patent [19]

Bell et al.

[11] Patent Number: 4,728,763

[45] Date of Patent: Mar. 1, 1988

[54] MICROWAVE OVEN HAVING A SOURCE OF INFRA-RED RADIATION

[75] Inventors: Geoffrey I. Bell; Peter W. Crossley, both of Havant; Alex L. Halberstadt, London; Stephen J. Newton, Haslemere; Susan M. Crocker, Southsea, all of England

[73] Assignee: Thorn EMI Appliances Limited, London, England

[21] Appl. No.: 935,928

[22] Filed: Nov. 28, 1986

[30] Foreign Application Priority Data

Nov. 30, 1985 [GB] United Kingdom ..... 8529580
Jul. 12, 1986 [GB] United Kingdom ..... 8617056

[51] Int. Cl.[4] ..... H05B 6/76

[52] U.S. Cl. ..... 219/10.55 B; 219/10.55 D; 174/35 R

[58] Field of Search ..... 219/10.55 D, 10.55 B, 219/10.55 R, 347–349; 174/35 R

[56] References Cited

U.S. PATENT DOCUMENTS 4,485,285 11/1984 Machesney ..... 219/10.55 BX
4,493,960 1/1985 Mittelsteadt et al. ..... 219/10.55 B

FOREIGN PATENT DOCUMENTS 2152790 8/1985 United Kingdom .

*Primary Examiner*—Philip H. Leung
*Attorney, Agent, or Firm*—Fleit, Jacobson, Cohn & Price

[57] ABSTRACT

A microwave oven consists of an oven cavity containing a turntable, a source of microwave energy and a waveguide for directing microwave energy into the oven cavity. Two lamp units accommodate tungsten-halogen lamps for browning food cooked by the microwave energy. To inhibit arcing through the lamps due to exposure to the microwave energy, support coils supporting the filament of each lamp are each formed from an incomplete turn of the coil to inhibit arcing between adjacent regions thereof. Other modifications to the lamps and/or the units may also be provided to protect the lamps from exposure to the microwave energy.

7 Claims, 7 Drawing Figures

MICROWAVE OVEN HAVING A SOURCE OF INFRA-RED RADIATION

Figure 1:
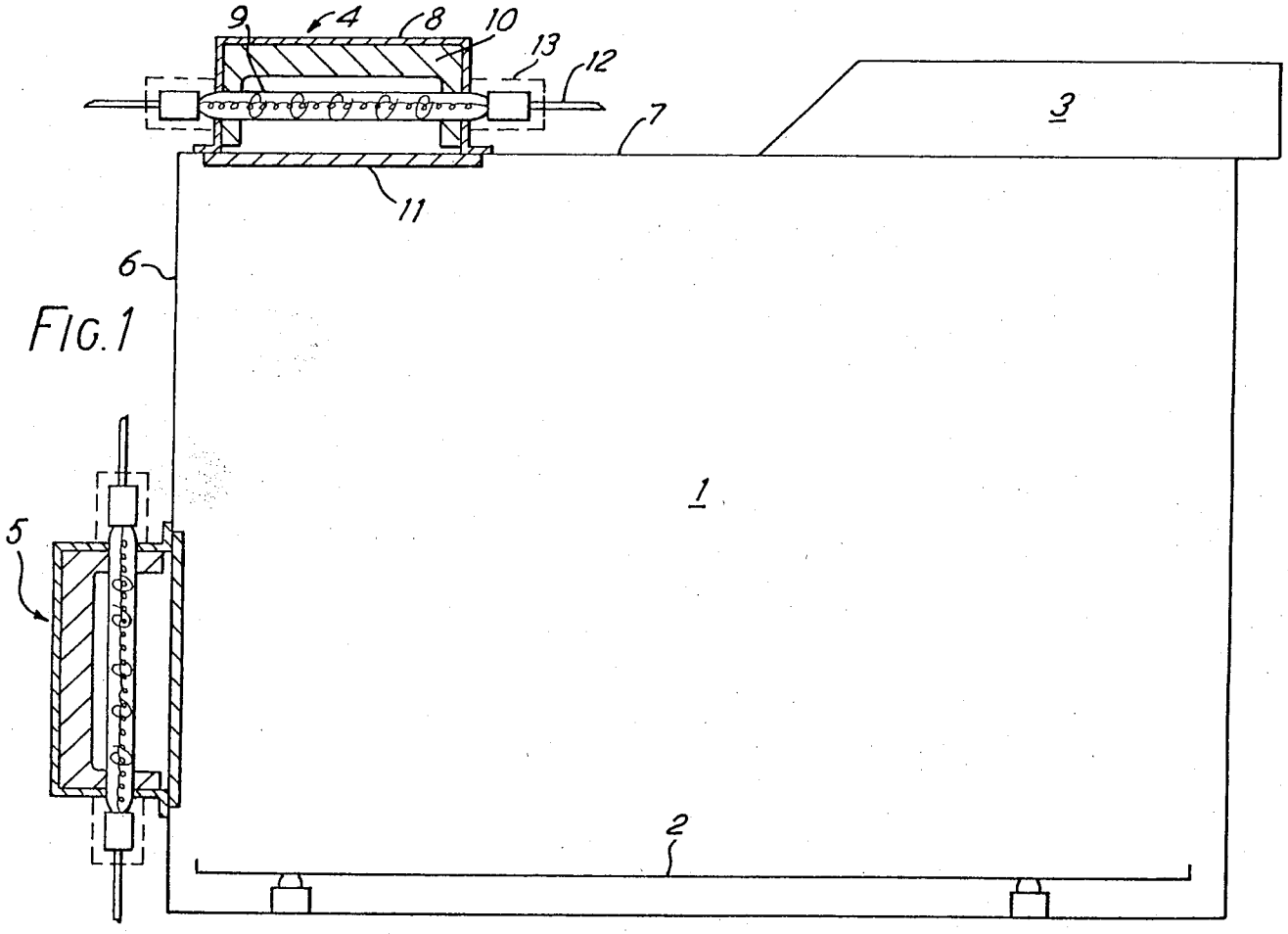

This invention relates to a microwave oven and in particular to such an oven including tungsten-halogen lamps as a means for browning food cooked by the microwave energy.

A microwave oven of this type is described in our copending UK Patent Pubn. No. 215279OA, wherein, in one embodiment, two heating units, each containing two tungsten-halogen lamps, are located at predetermined positions adjacent openings into the oven cavity, so that infra-red radiation generated by the lamps is emitted towards food within the oven cavity to effect optimum browning thereof. Each lamp comprises a tungsten filament supported by spiral supports within a sealed, halogenated quartz envelope.

To prevent damage to the lamps, it is necessary to protect them from the microwave energy within the cavity, and to this end the above-mentioned Patent Pubn. No. 215279OA describes in one embodiment the provision of a protective screen, positioned over the opening and having a number of apertures dimensioned to inhibit the passage of microwave energy through it, whilst permitting the passage of infra-red radiation. As alternative or additional protection for the lamps, a microwave choke arrangement may be used, which consists of waveguides dimensioned and located relative to the lamps to inhibit transmission of microwave energy from within the oven cavity to the lamps.

However, the use of a choke arrangement alone may not be sufficient protection for the lamps, which still tend to be exposed to sufficient microwave energy to cause ionization of the gaseous fill of the lamps. This can lead to arcing through the lamps and/or the formation of localised hotspots, which may cause a break down in the regenerative halogen cycle, or overheating which can cause the lamp filaments to flare, thereby substantially reducing the operative life of the lamps.

It is therefore an object of the present invention to provide a microwave oven including an improved tungsten-halogen lamp, which is less vulnerable to damage, when exposed to microwave energy, by inhibiting arcing and/or the formation of localised hotspots within the lamp or overheating of the lamp, which can result from exposure of conventional lamps to microwave energy.

In accordance with the present invention, there is provided a microwave oven comprising a source of microwave energy and at least one source of infra-red radiation, said at least one infra-red source including an infra-red-emissive lamp comprising a tungsten filament supported by a number of spaced support coils within a halogenated tubular envelope, each of said coils consisting of a first wire portion attached at one end to said filament and extending at the other end to form a second wire portion curled around the inner wall of said envelope, said second wire portion consisting of an incomplete turn of the coil to inhibit arcing between adjacent regions thereof due to exposure to said microwave energy.

The gaseous fill of the tungsten-halogen lamp preferably consists predominantly of nitrogen with a halogen additive to inhibit arcing between the ends and/or the filament of the lamps, which can occur if other gases, such as argon, are used instead of nitrogen.

Each end of the lamp filament within the envelope is provided with an electrical connection to connect the filament to a power supply located externally of the lamp, and each electrical connection of the lamp filament is preferably positioned so as to be shielded from the microwave energy by a wall of a metallic casing accommodating the lamp, thereby inhibiting the formation of localised hotspots at the electrical connection.

When more than one lamp is accommodated in a unit, preferably the location of any electrical interconnection between the lamps is external of the unit to inhibit the generation of high-frequency currents circulating through the lamps.

It is also preferable that the length of electrical lead of each lamp located inside the unit is minimised, to inhibit the generation of high-frequency currents in the leads.

Figure 2:
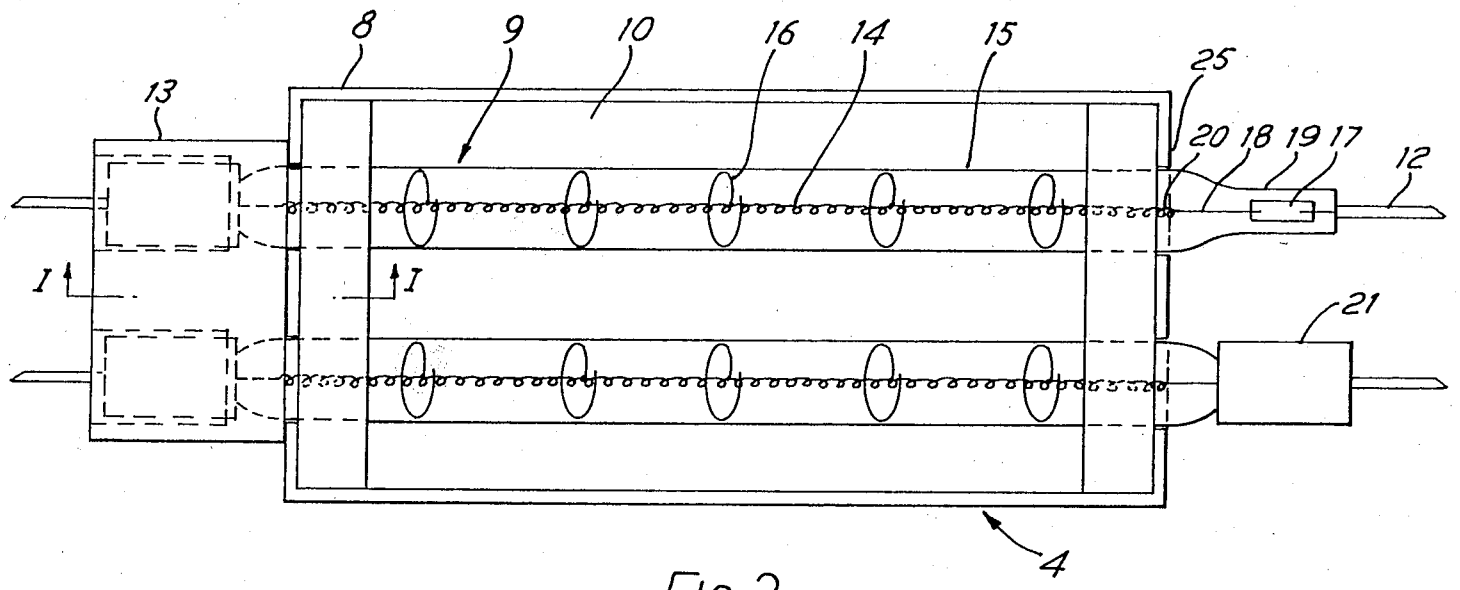
Figure 3:
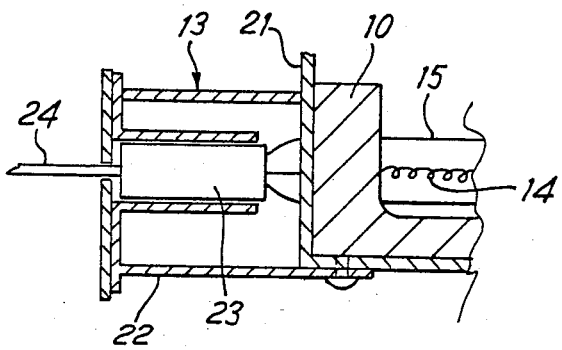
Figure 7:
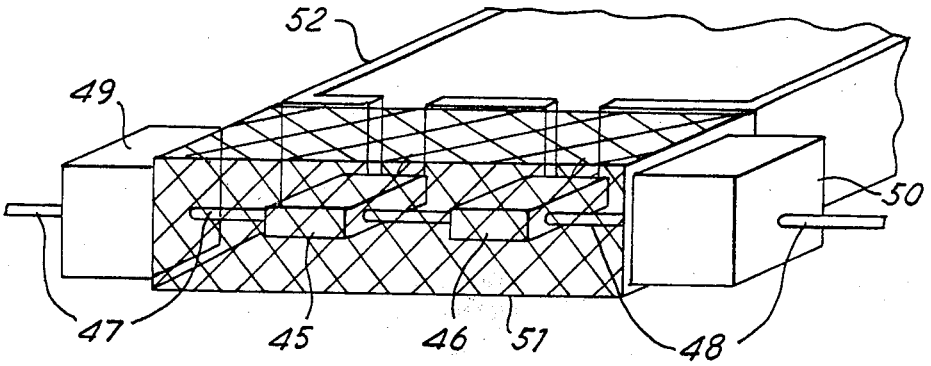
Figure 4:
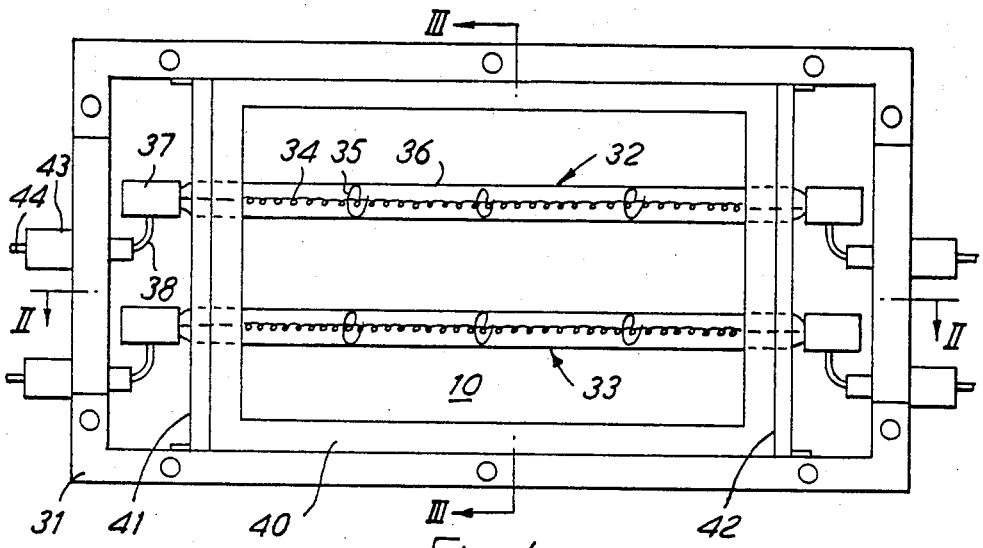
Figure 5:
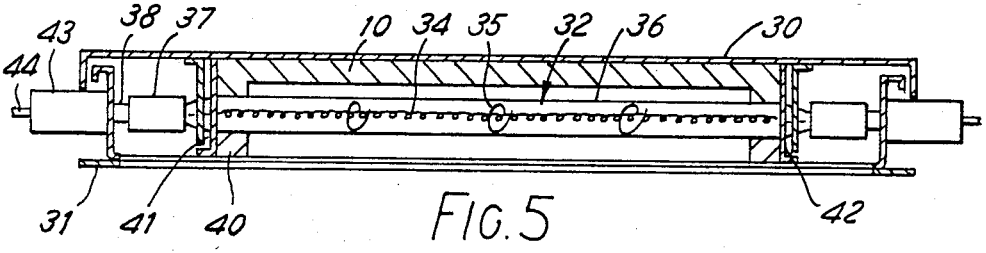
Figure 6:
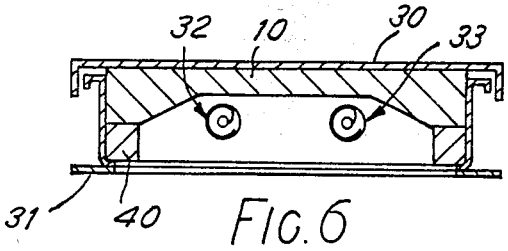

The invention will now be further described by way of example only with reference to the accompanying drawings, wherein:

FIG. 1 shows a schematic sectional view of a microwave oven incorporating tungsten-halogen lamp units, FIG. 2 shows a more detailed schematic plan view of a lamp unit shown in FIG. 1, incorporating the present invention, FIG. 3 shows a sectional view through I—I in FIG. 2, FIG. 4 shows schematically an underside plan view of a second embodiment of a lamp unit, in accordance with the invention, FIG. 5 shows schematically a sectional view through II—II in FIG. 4, FIG. 6 shows schematically a sectional view through III—III in FIG. 5, and FIG. 7 shows a schematic perspective end view of part of a third embodiment of a lamp unit.

A microwave oven, shown in FIG. 1, consists of an oven cavity 1 containing a turntable 2, upon which food is supported to be cooked by microwave energy emitted from a source (not shown) and directed into the oven cavity 1 by a conventional waveguide 3, stirrer and/or other suitable means.

Two lamp units 4, 5 are positioned outside of the cavity 1 at predetermined locations adjacent respective openings in side wall 6 and top wall 7 of the cavity 1. Each lamp unit 4, 5 consists of a metallic casing 8 accommodating tungsten-halogen lamps, such as at 9, around which a thermally-insulative or ceramic material 10 is provided to alleviate dissipation of heat from the unit 4, 5 and partially to reflect infra-red radiation emitted from the lamps, as well as providing support for the lamps.

The lamps 9 generate radiation in the near-infra-red range within a wavelength band of 0.8–5 $\mu$m with a peak at approximately 1.2 $\mu$m.

A protective screen 11 is positioned over each opening into the cavity 1, the screen being formed from any suitable infra-red-transmissive material, such as glass ceramic, to prevent the lamps and the interior of the unit from being damaged and/or soiled by food particles or other cooling products dissipated from food being cooked in the cavity 1.

Infra-red radiation emitted from the lamps 9 is thus directed into the oven cavity 1, through the screen 11, to brown food being cooked by the microwave energy, the lamp units 4, 5 being positioned at predetermined locations to achieve an optimum browning effect.

The protective screen 11 does not prevent exposure of the lamps to the microwave energy, so that microwave energy can be transmitted from the lamp filament to lamp leads 12 and thus to outside of the cavity 1, causing an unacceptable leakage of the microwave energy. To inhibit such leaks, the ends of each lamp 9 is provided with a microwave attenuating device, attached to the casing 8, as shown in outline at 13, which will be described in more detail hereinafter.

One of the lamp units 4 is shown in more detail in the plan view of FIG. 2, wherein like parts are labelled with like reference numerals, with respect to FIG. 1.

Each lamp 9 of the unit 4 consists of a linear or coiled coil tungsten filament 14 supported within a tubular quartz envelope 15 by a number of spaced support coils, such as at 16, each consisting of a coiled wire having a first portion wrapped, at one end, around the filament 14 and extending radially in the envelope to form a second portion curled around the inner wall of the envelope 15.

Each end of the filament 14 is electrically connected to the flying lead 12, or other suitable connector, for connection to a power supply for the lamp, via a molybdenum foil 17 and a tail wire 18 sealed within a pinch seal 19 of the envelope 15. End 20 of the tail wire 18 emergent from the pinch seal 19 is formed into a short coil, which is interlinked with the end turns of the filament 14 to provide the electrical connection.

The envelope 15 has a gaseous fill sealed therein, which fill includes a halogen additive, providing a regenerative halogen cycle to increase the longevity of the lamp filament.

The pinch seal at the ends of each lamp are preferably enclosed within a ceramic housing, such as at 21, the housing for pinch seal 19 having been removed to reveal the pinch seal construction. The ceramic housings 21 are provided to protect the pinch seals from mechanical damage and/or overheating by exposure to infrared radiation from the filament.

As indicated in FIG. 1, the ends of the lamps are enclosed within a microwave attenuating device 13, the device at one end of the unit shown in FIG. 2 having been removed for clarity.

One example of a suitable microwave attenuating device is shown in FIG. 3, wherein the device 13 consists of a conventional quarter-wave choke. The choke consists of a metallic, short-circuited stub 22, having a rectangular cross-section, which fits over ceramic end cap 23 of the lamp and surrounds lamp lead 24. The stub 22 has a length commensurate with a quarter of the wavelength of the microwave energy, which produces an electrical open-circuit to propagating microwaves, thereby inhibiting their transmission along the lamp lead 24. Preferably, the stub 22 encloses the end caps of both of the lamps in each unit, but each lamp may alternatively be provided with an individual stub.

The temperature of the pinch seals of the lamps should not exceed approximately 350° to prevent damage to the lamps due to overheating and, to this end, a number of holes (not shown) are preferably provided in some or all of the top and side walls and the base of the attenuating device 13 to increase air circulation and reduce thermal conduction from the oven cavity.

Although the microwave attenuating device 13 inhibits microwave leakage, it does not provide any protection for the lamps from the microwave energy and is thus insufficient by itself to inhibit damage to the lamps and a reduction in their operative life. Major causes of lamp failure due to exposure to microwave energy are arcing through the lamp, which occurs when the gaseous fill is ionised by the microwave energy, and the formation of localised hotspots within the lamp.

To substantially reduce the vulnerability of the lamps to the microwave energy, in accordance with the present invention, the lamps are provided with one or more modifications to alleviate the above problems of arcing and/or localised hotspots.

A first modification is to the support coils 16, which, in conventional tungsten-halogen lamps, each consists of more than one complete turn, generally 4/3 turns, of the wire portion curled around the inner wall of the envelope. However, it has been found to be advantageous to reduce the coil length to less than one complete turn, preferably to $\frac{3}{4}$ or $\frac{7}{8}$ of a turn, as shown in FIG. 2, thereby inhibiting arcing which tends to occur between adjacent turns of a conventional support coil, when the lamp is exposed to microwave energy. In a preferred construction, the coil diameter is 7.7–7.8 mm and the gap left in the coil turn around the inner wall of the envelope is 2–3 mm.

A second modification is to the gaseous fill of the lamps, which conventionally consists predominantly of an inert gas, usually argon, together with a halogen additive sufficient in quantity to provide the regenerative cycle. However, it has been found to be particularly advantageous to utilise a fill predominantly of nitrogen with a halogen additive, which is less susceptible to ionisation by the microwave energy, and thus to arcing between the lamp ends and/or the filament, than conventionally used fills.

A third modification of the lamps is to the positioning of the electrical connection between the tail wire 18 and the end of the filament 14. When this connection is exposed to relatively high intensities of microwave energy, it tends to form a localised hotspot, which may cause a visual disturbance to a user of the microwave oven, as well as reducing the life of the lamp. To inhibit the formation of such a hotspot, the lamp is arranged such that the electrical connection is shielded from the microwave energy by positioning it adjacent a wall of the metallic casing 8, as shown by the connection between tail wire 18 and filament 14 adjacent wall 25 of the casing 8. The metallic wall 8 thus acts as a shield to protect the electrical connection from the microwave energy.

It can thus be envisaged that by using one or more, and preferably all three, of the above-described modifications, the vulnerability of the lamps to damage by microwave energy is substantially reduced, thus increasing the operative life of the lamps.

In another embodiment a lamp unit as shown in FIGS. 4 to 6, consists of an upper casing 30 and a lower casing 31, both preferably made of metal, such as stainless steel. Two infra-red lamps 32, 33 are accommodated in the unit, each lamp comprising a tungsten linear or coiled coil filament 34 supported by support coils 35, modified as described above, in a halogenated quartz envelope 36. Each end of each lamp is sealed by a pinch seal (not shown) enclosed in a ceramic end cap 37, from which an electrical lead 38 is emergent for connection of the filament to an external power supply (not shown).

Adjacent the lamps 32, 33 is layer 10 of thermally-insulative material, which is preferably a ceramic fibre and may be reflective of infra-red radiation emitted by the lamps. The lamps 32, 33 are retained in the unit adjacent their ends by a rectangular portion 40 of thermal insulation, which may also consist of ceramic fibre. Also retaining the lamps are two dividing walls 41, 42, which partition the filament portion of the lamps from its end portions.

The lower casing 31 is open, at least in the vicinity of the lamp filaments, so that infra-red radiation generated by the lamps can be emitted out of the unit.

When used in a microwave oven, the unit is positioned so as to open into the oven cavity, so that food cooked by the microwave energy in the oven can be browned by infra-red radiation from the lamps.

To inhibit overheating, and thus flaring, of the lamps, which is caused by exposure of the lamps to microwave energy, in addition to one or more of the above-described modifications to the lamp, it has been found advantageous to ensure that any electrical interconnection between the lamps of the unit is made externally of the unit and/or that the length of the lamp lead within the unit is minimised.

To this end, the leads 38 for the lamps are separately emergent from the unit and each lead is provided with an individual quarter-wave choke 43, which inhibits transmission of microwave energy along the lead. Once outside of the unit, external leads 44 may be connected together to a common power supply (not shown).

As the lamps are separate from each other within the unit, the generation of circulating high-frequency currents through the lamps, which cause overheating and thus flaring of the lamps, is inhibited.

Additionally or alternatively, the length of lead 38 within the unit is minimised, which inhibits the generation of high-frequency currents in the leads.

Furthermore, the unit, consisting of upper and lower casings 30, 31 has also been designed to have increased rigidity and strength, and the individual chokes 43 have been fixed to the unit casing by screw-thread (not shown), which both aid in reducing the leakage of microwave energy from the unit.

FIG. 7 shows an alternative arrangement of the microwave attenuating device shown in FIGS. 1 to 5. FIG. 7 shows schematically an end perspective view of a lamp unit, showing two end caps 45, 46 of the lamps of the unit. In this arrangement, lamp leads 47, 48 extend laterally from the end caps 45, 46 respectively and respectively pass through two microwave attenuating devices 49, 50. Between the two devices 49, 50 and surrounding the end caps 45, 46 is a metal mesh 51, which is attached to the metallic casing 52 of the unit. The mesh 51 permits sufficient cooling of the lamp ends, as well as inhibiting leakage of the microwave energy propogated along the lamp leads.

The microwave attenuating devices shown in the Figures may consist of any suitable arrangement, such as the quarter wave choke shown in FIGS. 2 and 3.

An alternative suitable device may include microwave absorbent materials, such as ferrite, which absorbs microwaves as they propagate down the lamp leads. A conventional embodiment of such a device includes one or more ferrite beads threaded onto the lamp lead and then enclosed within a metallic sleeve.

We claim:

1. A microwave oven comprising a source of microwave energy and at least one source of infra-red radiation, said at least one source of infra-red radiation including an infra-red emissive lamp comprising a halogenated tubular envelope having an internal surface, a tungsten filament and a number of spaced support members supporting the tungsten filament on, or adjacent to, a longitudinal axis of the envelope wherein each said support member consists of a coil of wire of which one part only bears against said internal surface of the envelope and the remaining portion is attached to the filament and extends to said internal surface, said one part extending part-way only around said longitudinal axis of the envelope so as to make an incomplete turn about said axis and thereby inhibit arcing between adjacent regions of the coil during exposure thereof to microwave radiation.

2. A microwave oven as claimed in claim 1 wherein the gaseous fill of said envelope consists predominantly of nitrogen with a halogen additive to inhibit arcing between the ends of said lamp and/or said filament.

3. A microwave oven as claimed in claim 1 wherein each infra-red source includes a metallic casing and each end of said filament is provided with an electrical connection to a power supply located externally of said lamp, each electrical connection being positioned so as to be shielded from the microwave energy by a wall of said metallic casing, thereby inhibiting the formation of localised hotspots at said electrical connection.

4. A microwave oven as claimed in claim 1 wherein the infra-red source comprises a unit including more than one lamp and electrical interconnection between said lamps is located external of said unit to inhibit the generation of high-frequency currents circulating through said lamps due to exposure to microwave energy.

5. A microwave oven as claimed in claim 1 wherein the infra-red source comprises a unit including at least one lamp and the length of electrical lead of each lamp located inside said unit is minimised to inhibit the generation of high-frequency currents in said lead due to exposure to microwave energy.

6. A microwave oven as claimed in claim 1 wherein each end or said lamp is enclosed within a microwave attenuating device to inhibit leakage of microwave energy from the oven.

7. A microwave oven as claimed in claim 6 wherein said microwave attenuating device consists of a quarter-wave choke.

* * * * *